United States Patent [19]

Rodemann

[11] Patent Number: 4,887,541

[45] Date of Patent: Dec. 19, 1989

[54] DEPLOYABLE FLOTATION DEVICE

[76] Inventor: Will B. Rodemann, 522-B Iroquois La., Oronoque Village, Stratford, Conn. 06497

[21] Appl. No.: 172,445

[22] Filed: Mar. 24, 1988

[51] Int. Cl.[4] ..... B63C 9/02

[52] U.S. Cl. ..... 114/68

[58] Field of Search ..... 441/30, 33, 93, 129, 441/131; 114/68, 360

[56] References Cited

U.S. PATENT DOCUMENTS

| | | | |
|---|---|---|---|
| 1,448,607 | 3/1923 | Tworski | 114/68 |
| 2,529,961 | 11/1950 | Phillips | 441/131 |
| 2,918,030 | 12/1959 | Bagnall | 441/30 |
| 3,005,214 | 10/1961 | Fruendt | 441/30 |
| 3,324,816 | 6/1967 | Vogelsang | 114/68 |
| 3,340,842 | 9/1967 | Winslow | 114/68 |
| 3,556,034 | 1/1971 | Miller | 114/54 |
| 3,797,435 | 3/1974 | Dunson | 114/68 |
| 3,822,662 | 7/1974 | Morita et al. | 114/68 |
| 4,458,618 | 7/1984 | Tuffier | 114/68 |
| 4,482,333 | 11/1984 | Geri et al. | 441/30 |

*Primary Examiner*—Sherman D. Basinger
*Assistant Examiner*—Stephen P. Avila
*Attorney, Agent, or Firm*—Patrick J. Walsh

[57] ABSTRACT

A deployable flotation device including buoyancy members tightly packed in a container mechanism in which the container is either permanently mounted within a watercraft or removably deployed for periodic recertification and receives inner and outer buoyancy members for providing positive buoyancy in a watercraft over a shelf life of up to five years. In a modification a single outer container may be used. A particular composition for the buoyancy member suitable for the marine environment is disclosed. Deployment may be manual, semi-automatic, or automatic depending on the requirements of particular watercraft.

12 Claims, 5 Drawing Sheets

DEPLOYABLE FLOTATION DEVICE

BACKGROUND OF THE INVENTION

The present invention is an improvement in the field of deployable flotation devices for maintaining buoyancy in marine vessels.

Marine vessels use both permanent buoyancy techniques and deployable flotation systems. Permanent flotation techniques include dedication of compartments within the vessel as flotation or buoyancy tanks. These are watertight compartments permanently sealed and often filled with buoyant foam material. Permanent techniques have the advantage of being in place and require no external agency or power for deployment. On the other hand, permanent techniques take up useful space, sometimes more so than can be tolerated. This is particularly the case with small watercraft where available space is limited. The prior art reveals a number of patents directed to deployable flotation systems to prevent sinking of marine vessels, or to aid in stabilizing powerless boats in rough seas, or to salvage submerged boats.

U.S. Pat. No. 1,448,607 entitled "Insubmergible Vessel" includes an installation in which prestored collapsed floats are inflated with air and deployed along the hull of the vessel to prevent sinking or to aid in raising the vessel if submerged. U.S. Pat. No. 2,918,030 is directed to the use of inflatable containers for raising a submerged vessel. The inflatable containers contain dry ice, for example, which sublimates, forming carbon dioxide for inflating the containers providing buoyancy to a submerged vessel. U.S. Pat. Nos. 3,797,435 and 3,822,662 are both directed to the use of emergency flotation equipment deployed along the broadsides of watercraft for the purpose of stabilizing the craft in rough seas.

The prior art reveals a number of other devices for providing buoyancy to submerged articles or objects. In the case of U.S. Pat. No. 3,556,034 a prepackaged buoyancy system containing a hydrazine gas generator is attached to a submerged object for providing buoyancy.

The traditional method for providing flotation in a boat or vessel has been through use of airtight and watertight compartments. Large commercial or service ships including naval vessels are constructed with bulkheads and bulkhead doors which can be sealed off through use of a screw mechanism connected to door latches. The sealing off of a compartment flooding with sea water will allow maintenance of sufficient buoyancy in the ship to keep her afloat. Construction of air and watertight compartments, however, is expensive and therefore are not used in anything but the largest of vessels. Lifeboats also are used for the saving of life if the ship goes down.

Smaller vessles, i.e., those below 100 feet in overall length, whether motor or sail, have generally not been equipped with sealable bulkheads. Instead, attention has been placed on use of pumps for the vessel and use of personal flotation devices for crew and passengers. Pumps usually cannot be large enough to save a sinking vessel which must be abandoned and allowed to sink even though if saved it could provide a safer and better platform for maintenance of life.

In recent years, beginning in 1978, the U.S. Coast Guard has been charged with maintaining a minimum requirement of level flotation for motor vessels under 20 feet, and the National Motor Boat Manufacturers Association (NMBMA) has adopted standards for motor vessels to 26 feet. But larger vessels are not covered partly because fixed flotation as used in lighter and smaller boats would in larger vessels take up a great proportion of internal space.

Thus, the disadvantages of existing methods can be summarized as:

1. Air and watertight compartments are expensive and not used except in larger vessles.
2. Fixed flotation such as foam-in-place takes up too much internal space to be practical except in the smallest and lightest of craft.
3. Pumps to remove flooding water will work initially but cannot be large enough to save a sinking ship.
4. Life rafts and personal flotation devices save lives but leave a ship to sink.

If the ship is saved it will provide a much better platform for maintenance of life, because food and water are generally available. Moreover, the ship itself will not be completely lost as at present.

Deployable flotation devices have substantial advantage in taking up far less space and are practical to use for life-saving and property salvage. Deployable devices of current design using standard materials occupy too much useful space and can be difficult to inflate and deploy particularly after a vessel is submerged. A typical existing design uses thick rubberized fabric and requires manual connection of air tanks for inflation.

SUMMARY OF THE INVENTION

The present invention is directed to an onboard deployable flotation device having sufficient buoyancy to float or prevent from sinking a watercraft which has shipped water and would otherwise sink. A distinguishing characteristic of the invention is the compact size of the flotation device in respect of its deployed volume so that the necessary number of flotation devices can be located in strategic positions throughout the vessel and rapidly deployed to provide positive buoyancy for the vessel to prevent sinking. The deployable flotation device according to the invention is an easily stowed, easy to deploy, quickly inflatable buoyancy bag or series of bags each of multiple wall construction using specially compounded polymer materials encased in a protective cover. I have determined that specific compounds formed from recently available polymers and additives will maintain elasticity, tensile strength, shear strength, and puncture resistance over temperature ranges and pressures normally encountered in the marine environment and that when enclosed in a movable (not bonded) protective fine-woven or matt cover the compounded materials are superior to rubberized fabrics used for deployable flotation devices in marine vessles. The outer protective cover preserves the buoyancy bag from abrasion and puncture.

A flotation device according to the present invention is advantageous in allowing location on the buoyancy device at a point separate from its means of inflation. Additionally, the flotation device can be located at the base of the floating vessel so as to keep the vessel in a buoyant condition and floating at the highest possible attitude or position. Finally, the flotation device can be removed from time to time and recertified as to its working condition.

It is another aspect of the present invention, to provide a deployment device which can be triggered manually or automatically by optional deployment mechanisms.

In one form of the invention an elastic flexible plastic inflatable bag with a protective fabric surface or cover is collapsed and placed in a small canister, container, or tube and is inflated by a self-contained gas supply or by in-place foaming agents or by a combination of the two. The flotation devices are stowed in out-of-the-way locations within the vessel such as the fore peak, engine compartments, under seats, bilges and so forth, and are permanently connected to one or more inflation tanks. The inflation tanks can be located alongside the buoyancy bags or a central tank may be used to inflate several remotely located buoyancy bags. On deployment the inflated bag and its protective cover are restrained preferably at the lowest possible location within the vessel by a restraining mechanism fitted to the boat.

The present invention is particularly suitable for commercial and recreational vessels such as fishing boats, motorboats, and sailboats. For each boat the buoyancy required for flotation can be determined and the boat fitted with a sufficient number of flotation devices of required displacement volume to meet such requirement. A safety factor of at least 15% is recommended.

OBJECTS OF THE INVENTION

It is an object of the invention to provide a deployable buoyancy device having an inner buoyancy bag with outer protective cover.

It is another object of the invention to provide a buoyancy bag fabricated of materials particularly suited for use in a marine environment.

It is a further object of the invention to provide a buoyancy bag having a removable container permitting periodic inspection and recertification of the buoyancy bag component of the deployable flotation device.

It is a further object of the invention to provide a deployable buoyancy device in which the buoyancy bag inflates to a substantial volume with respect to initial size.

It is a further object of the present invention to provide a deployable flotation device which is suitable for installation in out-of-the-way places in a marine vessel.

A further object of the present invention is to provide for manual or automatic operation of the deployable flotation devices within the watercraft.

Another object of the invention is to provide a deployable flotation device which can be installed as needed in existing vessles without redesign of the vessel interior.

Other and further objects of the invention will become apparent upon an understanding of the following specification or upon employment of the flotation device in practice.

DESCRIPTION OF THE DRAWING

A preferred embodiment of the invention has been chosen for purposes of description in connection with this specification and is shown in the accompanying drawing in which.

Figure 1:
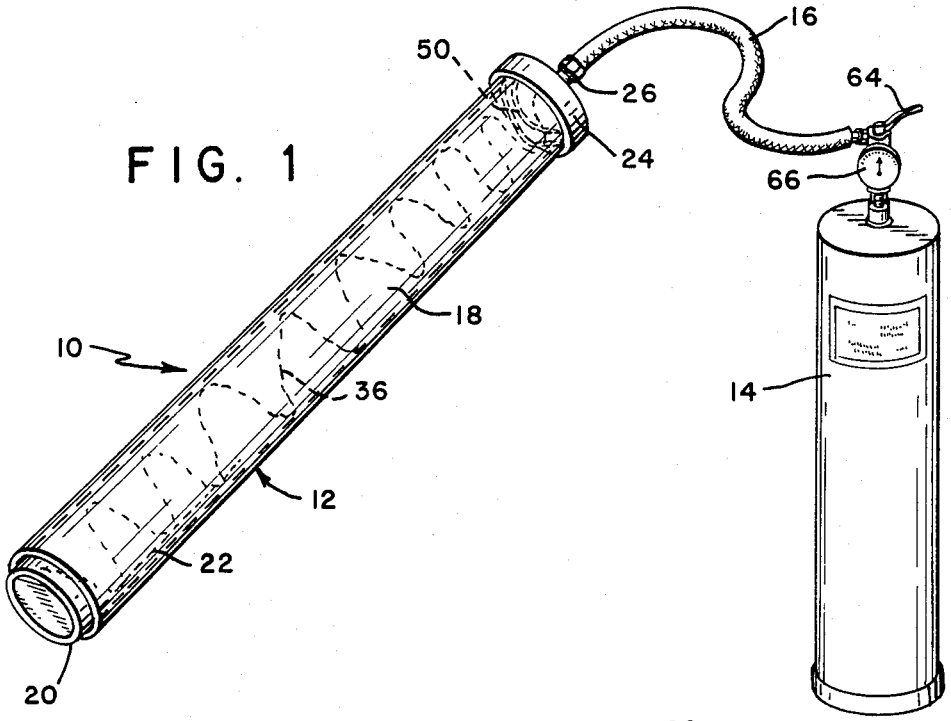
FIG. 1 is an assembly view of the present invention including outer container, inner inflatable buoyancy bag container, flexible filler hose and a pressurized gas tank.

Referring now to the drawing and in particular to FIG. 1, the present invention comprises a deployable flotation device 10 having a flotation member 12 and pressurized tank 14 interconnected by a flexible filler hose 16. The flotation member includes an outer container 18 permanently mounted in a watercraft, and an inner container 20 which receives a deployable flotation member 22. Both the outer and inner containers are tubular and may be either circular or rectangular in cross-section.

The outer container is a rigid tube formed of a suitable material such as polyvinyl chloride and having an end cap 24 securely fitted to one end of the tube. The end cap receives an outer filling connector 26 (FIG. 8) having an internal duct 28 for connection to gas filling hose 16 and to a corresponding buoyancy bag inner filling connector 30 having an internal duct 31. When assembled the inner and outer filling connectors snap together to permit removal of the inner container for periodic recertification and replacement.

Figure 3:
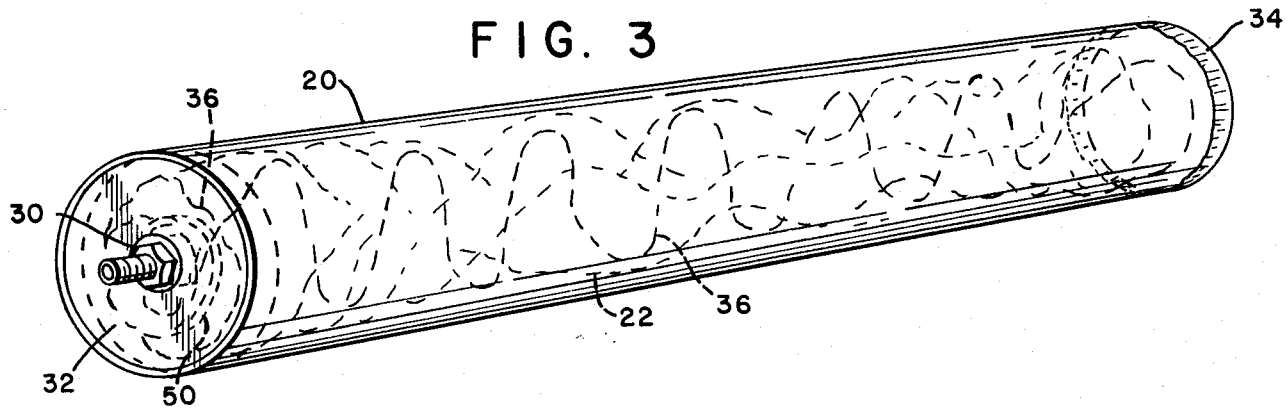
FIG. 3 is a perspective view of the inner container showing the fittings for inflation thereof.
Figure 4:
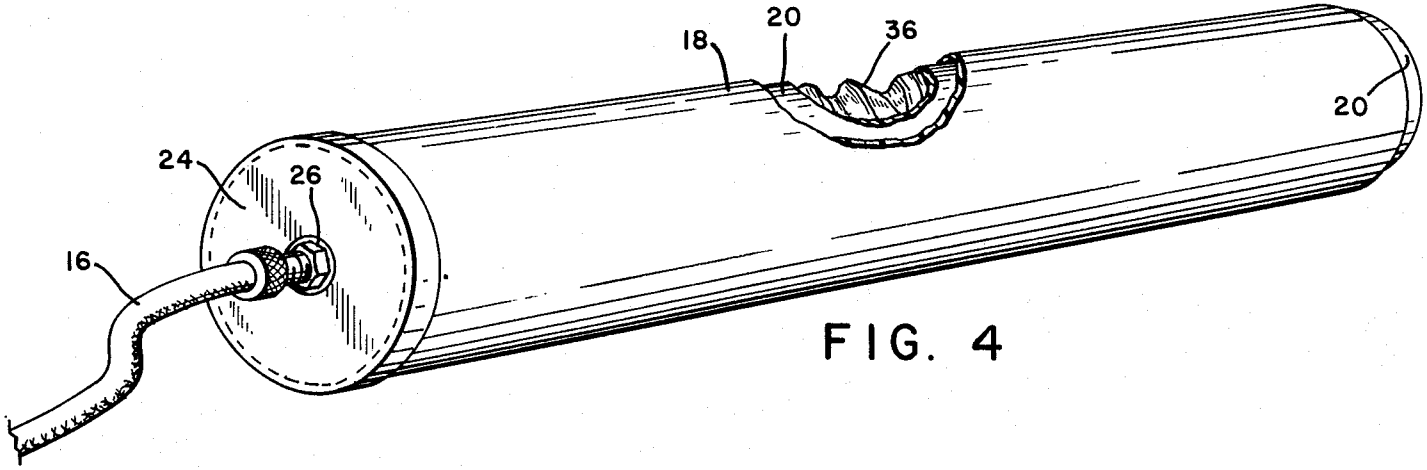
FIG. 4 is a perspective view of the outer container for receiving the inner container of FIG. 3 and particularly showing the connections for inflation.
Figure 8:
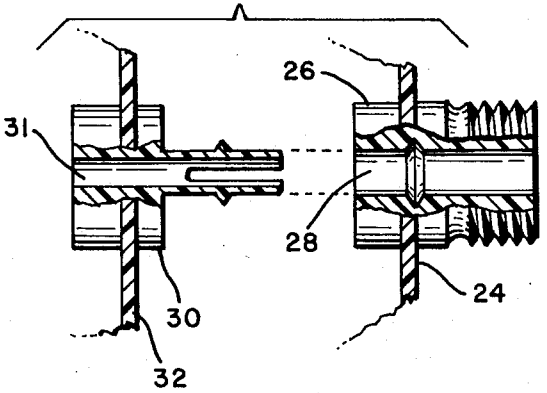
FIG. 8 shows the snap-connector filling connection between inner and outer containers.

The inner container 20 is dimensioned to fit inside the outer container with sufficient length to protrude from the outer container so that it can be grasped for removal as desired. As shown in FIG. 3, the inner container preferably fabricated of a rigid material such as polyvinyl chloride includes a flanged end cap 32 tightly fitted to one end of the container and secured thereto by a suitable adhesive or heat seal. Inner filling connector 30 is secured to the end cap for connection to the outer filling connector as shown in FIG. 8. The other end of the inner container is covered by a frangible seal 34 which ruptures upon deployment of the inner buoyancy bag. The frangible end seal is fabricated of tearable paper or plastic and can be printed with information regarding recertification procedures, replacement dates, and so forth,. The inner and outer containers and their end caps may be formed of materials other than polyvinyl chloride including polystyrene, acetates, or polyethylene.

Figure 2:
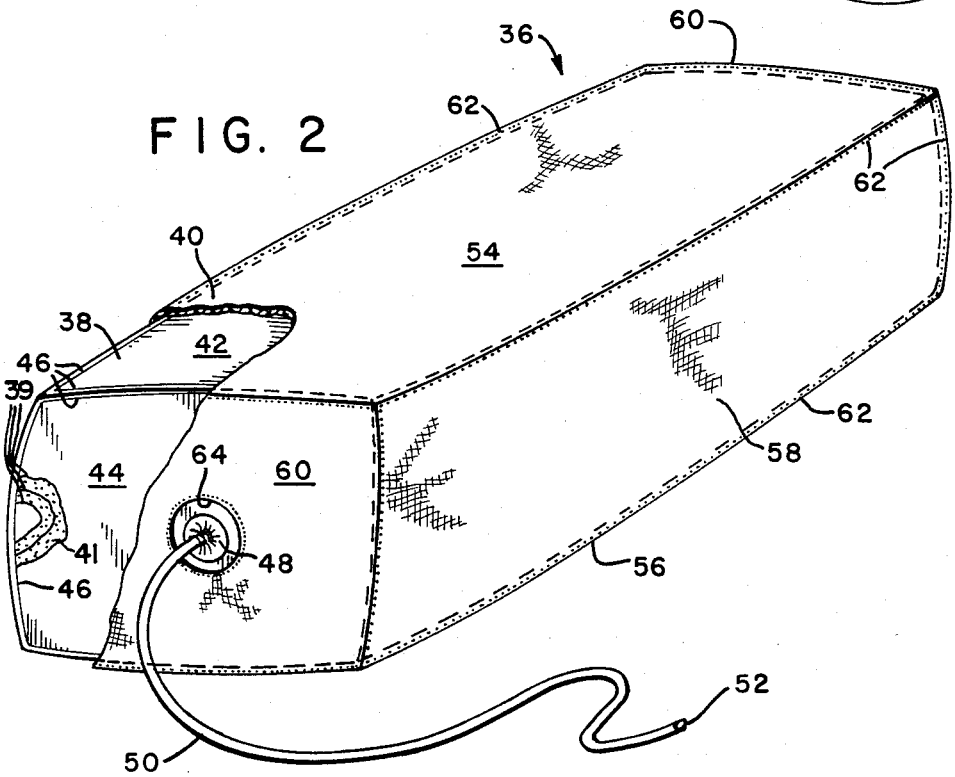
FIG. 2 is a perspective view of the inner inflatable buoyancy bag and outer protective cover partly cut away shown in inflated shape for deployment.

As best shown in FIGS. 2 and 3, the deployable flotation device includes a flotation member 36 initially contained within the inner container which when deployed is inflated as shown in FIG. 2. The flotation member includes an inner flotation bag 38 surrounded by an outer protective cover 40. The inner buoyancy bag when inflated may be of generally rectangular or cylindrical shape and has corresponding body panels 42 and end panels 44 joined together along seams 46 which are heat or adhesive sealed. One of the end panels of the buoyancy bag includes a flexible filler panel 48 and tube 50 connected to end panel 44 for purposes of inflation. The free end 52 of the filler tube is secured to inner filling connector 30. Additional back-up filler tubes and valves as well as a pressure check-valve are normally used on this or another panel of the buoyancy bag.

The buoyancy bag 38 is either of single or multiple ply and must fold within its outer protective cover 40 for insertion and storage in the relatively small space of inner container 20 without loss of tensile, flex, shear, or tear strengths or puncture resistance of the inflated bag. Multiple ply buoyancy bags with individual plies of the same or dissimilar materials are preferred for larger vessels requiring larger buoyancy volumes. The multiple plies 39 can be bonded to each other for greater mechanical strength, wall stiffness and resistance of failure. The plies can be nonbonded for greater flexibility and ease of folding and stowage of the buoyancy bag in its container. Additionally, with nonbonded plies it is desirable to have plating or slippage between each ply through the use of dissimilar ply materials or by use of slip agents 42 between plies of similar materials.

The filler tube 50 in single or multi-layer bags is of the same configuration, and it is always connected to the innermost buoyancy bag even in a multi-layer construction. Ordinarily it will be constructed of the same polymer material as the bag in order to form the strongest bond but it may be constructed of some other polymer as long as adequate bonding at its end will occur. Bonding will normally be by heat, whether through high-frequency energy or by plate-type heaters, the heat melting enough of the thermoplastic polymer in both bag and tube ending to form a molecular bond.

The buoyancy bag and filler tube may use low density polyethylene, linear low density polyethylene, polyurethanes to provide the bag with balloon-like flexibility and inflatability, a shelf life of between two and five years in a marine environment without undue loss of flexibility or deterioration such as crack of craze failure.

As shown in FIG. 2, the protective outer cover 40 closely conforms to the contour of the buoyancy bag being generally rectangular or circular in cross-section and formed of top 54, bottom 56, side 58 and end panels 60 sewn together along their edges 62. One of the end panels has a hemmed circular opening 64 to accommodate access of the filling tube to the inner buoyancy bag. It is desirable that the outer dimensions of the protective cover be slightly smaller than the outer dimensions of the inflated inner buoyancy bag to add to the strength and rigidity of the deployed buoyancy member.

The protective cover is preferably fabricated of finely woven polyester fiberglass for greatest puncture and abrasion resistance. Other fibers, such as rip-stop nylon, can be used. The buoyancy cover is capable of being foled and rolled into the smaller dimensions of the inner container being packed loosely enough within such container to quickly emerge and erect upon inflation.

The woven or nonwoven matt protective buoyancy cover of FIG. 2 is fully independent yet encloses the inner buoyancy bag and the end of its filler tube. The cover is of a strong rip-stop type material such as some types of nylon or other synthetic fabric. The arrangement of a protective cover as a separate independent layer shaped around the inner buoyancy bag itself, is based on the discovery that greater composite strengths and resistance to tear and puncture result if a single or multi-layer elastomer structure is made up of nonbonded layers of appropriate dimensions. The dimensions must be such that the outer elastomer layers, while separate and not bonded to inner layers, are of smaller size than succeeding inner layers. This removes some tensile stress of inflation from the inner-most layers, and the outer layers are ultimately contained or restrained within the larger protective cover which itself does not stretch as much as the inner elastomer structure.

Figure 5:
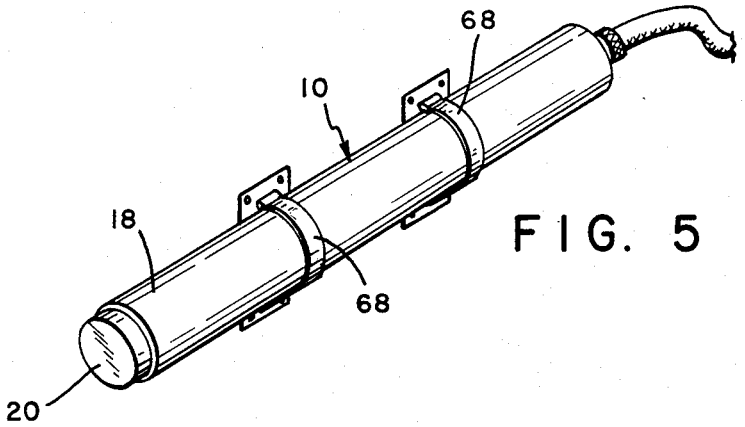
FIG. 5 is a perspective view of the mounting arrangement for the buoyancy device according to the present invention.

As shown in FIGS. 1 and 5, the assembled flotation device is connected by flexible filler hose to a pressure tank of suitable capacity for inflating one or more flotation members. The pressure tank is constructed of aluminum or stainless steel suitable for gases, pressures and for a marine environment. The pressure tank includes a valve actuator 64 and a pressure gauge 66 to indicate operating condition. The tank valve actuator and pressure gauge are conventional available materials as is the flexible filler hose 16. The pressure tank may contain gasses such as carbon dioxide or nitrogen in gas or liquid form to provide the necessary inflation. If desired, other inflating mechanisms such as pyrotechnic devices suitable for elastomeric buoyancy bags may be used. As shown in FIG. 5, the flotation device is mounted permanently within a watercraft by conventionally available snap-on mounting clamps 60.

Figure 6:
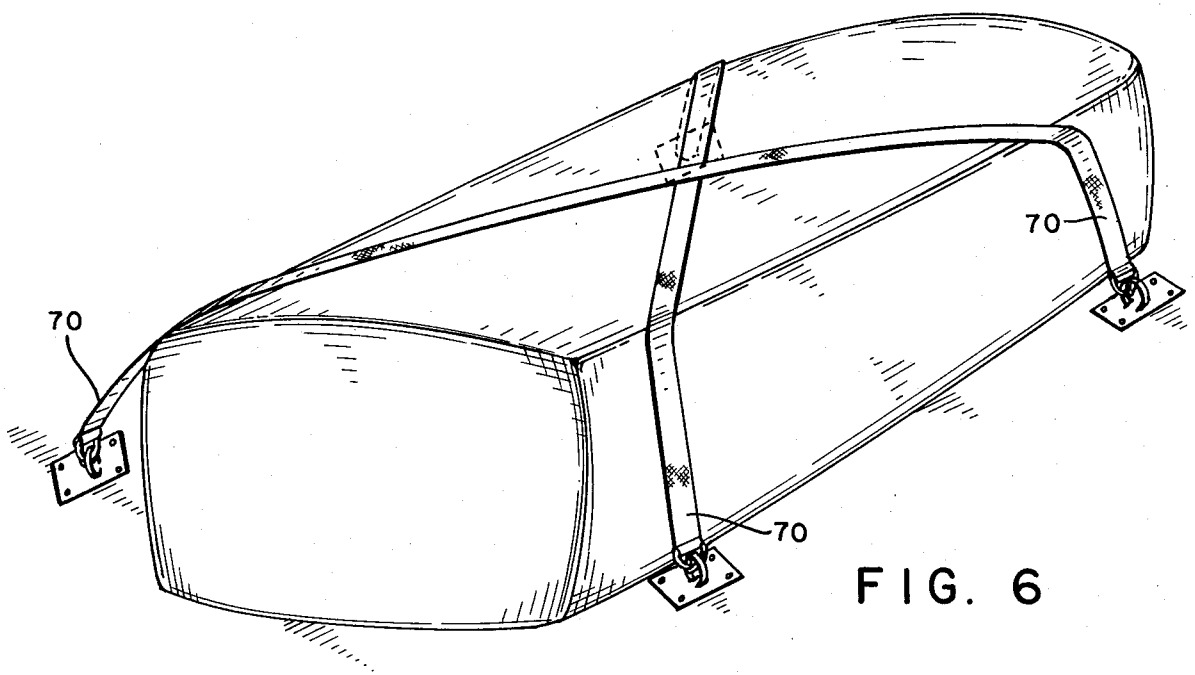
FIG. 6 is a perspective view showing the hold down arrangement for deployed buoyancy bag according to the present invention.

As shown in FIG. 6, tie downs 70 may be manually deployed to secure and hold a deployed buoyancy member in place at desired locations within the watercraft. Alternatively, automatically deployed hold down means such as telescopic tubes or pantograph devices may be used.

Figure 7:
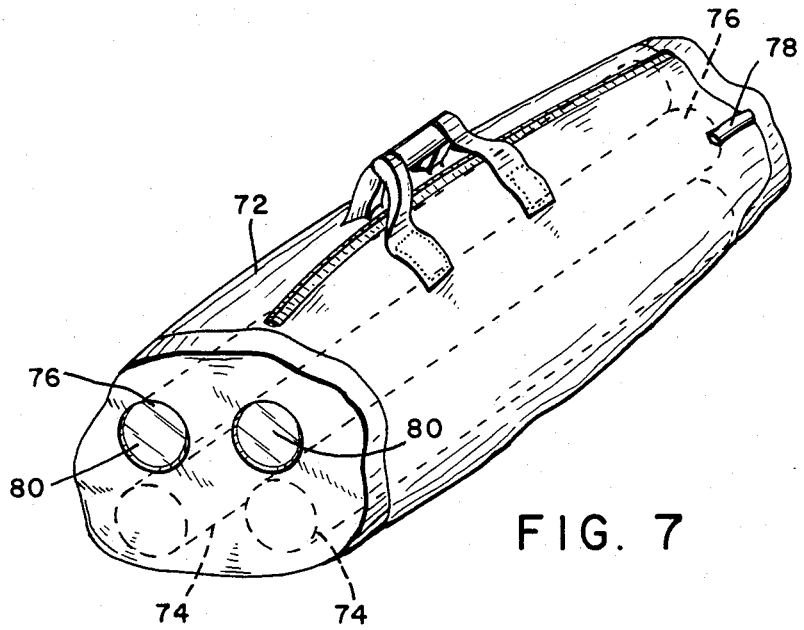
FIG. 7 is a modification of the present invention showing a carry-all arrangement for carrying and positioning flotation devices according to the present invention.

FIG. 7 illustrates a portable arrangement in the form of a carryall 72 in which the entire assembly of pressure container 74, flexible filling hose, and deployable buoyancy members 76 are located within a carry-all container. In this arrangement, the carry-all container is divided horizontally with the flotation members located above and the inflation tanks located below. A suitable lanyard handle 78 may be used for deployment. With this arrangement the end panel of the carry-all has frangible opening 80 to allow emergence of the deployed flotation bags. The flotation device is capable of manual operation, as for example, by a hand operated lanyard or lever device. Additionally, the deployment may be semi-automatic with a control mechanism located on the bridge or other convenient location for purposes of deploying one or more buoyancy bags on command through the electronic control. Alternatively, the operation may be fully automatic through the intermediation of a water level sensor in place of a manual switch so that should be a compartment of the vessel be flooded deployment occurs automatically.

Figure 9:
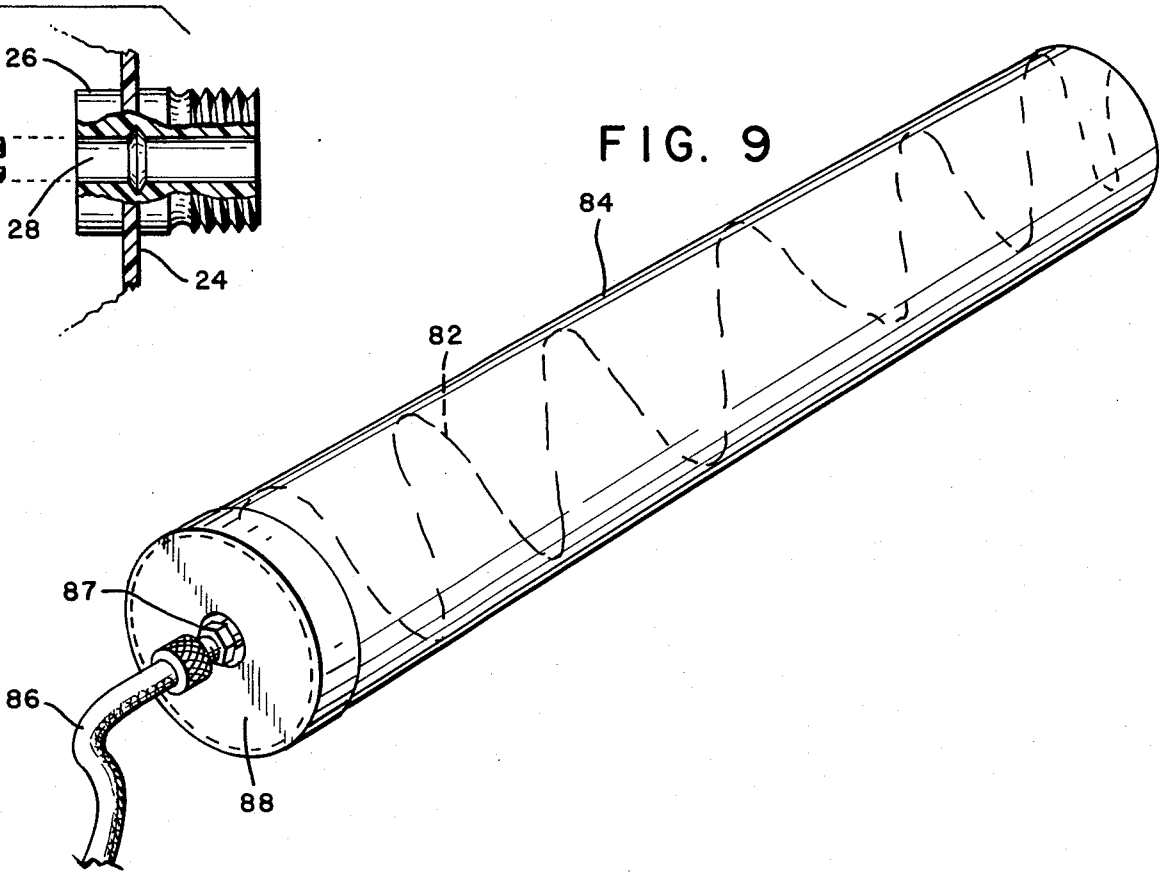
FIG. 9 is a modification of the present invention using a single container to receive a deployable buoyancy bag.

In a modification of the invention shown in FIG. 9, the deployable flotation device may omit the inner container for receiving the deployable inflatable bag. In this modification the inflatable bag 82 is inserted into an outer container 84 with the flexible filling hose 86 connected to an outer filling connector 86 located in the container end wall 88. For recertification, the outer container with folded bag are disconnected from the filler tube 80.

It will be thus seen that the present invention provides a convenient, efficient and effective deployable flotation device which can be located in various out-of-the-way places in marine vessels for deployment as desired for lifesaving and property salvage purposes.

I claim:

1. A deployable buoyancy device for marine vessels comprising a tubular container, means for mounting the container in a fixed location within a marine vessel, a buoyancy member folded and inserted in collapsed condition within the container, the buoyancy member having an inner inflatable buoyancy bag formed of multiple elastomeric layers and an outer protective cover as a separate independent layer shaped around the inner buoyancy bag, the outer layer of the inner buoyancy bag being of smaller size than succeeding inner layer(s) and the outer protective cover being of smaller size than the inner buoyancy bag to reduce shear and improve tear strength of the buoyancy member, inflation means for admitting inflating medium into the buoyancy bag, means for connecting the inflation means to a source of inflation medium, and means for inflating the buoyancy member and for ejecting the same from the container into a compartment of the marine vessel to provide buoyancy.

2. A deployable buoyancy device for marine vessels comprising a tubular container, means for mounting the container in a fixed location within a marine vessel, a buoyancy member, an inner container for receiving the buoyancy member in collapsed condition, the inner container being placed inside the tubular container, the buoyancy member having an inner inflatable buoyancy bag formed of multiple elastomeric layers and an outer protective cover as a separate independent layer shaped around the inner buoyancy bag, the outer layers of the buoyancy member being of smaller size than succeeding inner layers to reduce shear and improve tear strength of the bag, inflation means for admitting inflating medium into the buoyancy bag, means for connecting the inflation means to a source of inflation medium, means for inflating the buoyancy member and for ejecting the same from the container into a compartment of the marine vessel to provide buoyancy.

3. A deployable buoyancy device as defined in claim 2 in which the tubular container is rigid and formed of polyvinyl chloride, has a cap fitted to one end of the tube, and has filling connections extending through the end cap between a source of inflation medium and the inner buoyancy bag.

4. A buoyancy bag is defined in claim 2 which the inner inflatable bag is fabricated of polyurethane plies.

5. A deployable buoyancy bag as defined in claim 2 in which the inner inflatable bag in which the inner bag multiple plies are dissimilar elastomeric materials.

6. A deployable buoyancy device for marine vessels comprising a tubular container, means for mounting the container in a fixed location within a marine vessel, a buoyancy member folded and inserted in collapsed condition within the container, the buoyancy member having an inner inflatable buoyancy bag formed of multiple elastomeric layers and an outer protective cover as a separate independent layer shaped around the inner buoyancy bag, the outer layers of the buoyancy member being of smaller size than succeeding inner layers to reduce shear and improve tear strength of the bag, inflation means for admitting inflating medium into the buoyancy bag, means for connecting the inflation means to a source of inflation medium, means for inflating the buoyancy member and for ejecting the same from the container into a compartment of the marine vessel to provide buoyancy, and said inner buoyancy bag when inflated being of generally rectangular shape having body panels and end panels joined together in seams with one of the end panels including a flexible filler panel and tube for purposes of inflation.

7. A deployable buoyancy bag as defined in claim 6 in which the inner inflatable bag has individual plies of the same materials bonded together for greater mechanical strength, wall thickness and resistance to failure.

8. A deployable buoyancy device for marine vessels comprising a tubular container, means for mounting the container in a fixed location within a marine vessel, a buoyancy member folded and inserted in collapsed condition within the container, the buoyancy member having an inner inflatable buoyancy bag formed of multiple elastomeric layers and an outer protective cover as a separate independent layer shaped around the inner bouyancy bag, the outer layers of the buoyancy member being of smaller size than succeeding inner layers of reduce shear and improve tear strength of the bag, the inner inflatable bag multiple plies being of the same elastomeric material nonbonded to each other, and having a slip agent between individual plies for greater flexibility and ease of folding and storage, inflation means for admitting inflating medium into the buoyancy bag, means for inflating the buoyancy member and for ejecting the same from the container into a compartment of the marine vessel to provide buoyancy.

9. A deployable buoyancy device for marine vessels comprising a tubular container, means for mounting the device in a fixed location within a marine vessel, a buoyancy member folded and inserted in collapsed condition within the container, the buoyancy member having an inner inflatable buoyancy bag formed of an elastomeric structure of at least one ply of low density polyethelene, linear low density polyethylene, or polyurethane and an outer protective cover as a separate independent layer shaped around the inner buoyancy bag, and the outer layer of the buoyancy member being of smaller size than the succeeding inner layer to reduce shear and improve tear strength of the bag, an inflation tube for admitting inflating medium into the buoyancy bag, the inflation tube connected to a source of inflation medium, means for inflating the buoyancy member and for ejecting the same from the container into a compartment of the marine vessel to provide buoyancy, and an open ended inner container for receiving the buoyancy member in collapsed condition for insertion into the tubular container, and the inflation tube being detachably connected to the tubular container for periodic removal and recertification of the buoyancy member.

10. A deployable buoyancy device as defined in claim 9 which further includes a rupturable decal with product indicia covering the open end of the inner container.

11. A deployable buoyancy device as claimed in claim 9 in which the outer protective cover is fabricated of finely woven polyester fiberglass.

12. A deployable buoyancy device for marine vessels comprising a carryall having a plurality of tubular containers for location within a marine vessel, a buoyancy member folded and inserted in collapsed condition within each container, each buoyancy member having an inner inflatable buoyancy bag formed of multiple elastomeric layers and an outer protective cover as a separate independent layer shaped around the inner buoyancy bag, the outer layer of the inner buoyancy bag member being of smaller size than succeeding inner layer(s) and the outer protective cover being of smaller size than the inner buoyancy bag to reduce shear and improve tear strength of the buoyancy member bag, inflation means within the carryall for admitting inflating medium into each buoyancy bag, means for connecting the inflation means to a source of inflation medium, and means for inflating each buoyancy member and for ejecting the same from each container and carryall into a compartment of the marine vessel to provide buoyancy.

* * * * *